United States Patent [19]

Mulder

[11] Patent Number: 4,600,603

[45] Date of Patent: Jul. 15, 1986

[54] POWDER SPRAY APPARATUS AND POWDER SPRAY METHOD

[75] Inventor: Douglas C. Mulder, Wellington, Ohio

[73] Assignee: Nordson Corporation, Amherst, Ohio

[21] Appl. No.: 732,375

[22] Filed: May 9, 1985

Related U.S. Application Data

[63] Continuation-in-part of Ser. No. 623,005, Jun. 21, 1984, Pat. No. 4,543,274.

[51] Int. Cl.[4] ..... B05D 1/12

[52] U.S. Cl. ..... 427/180; 427/421; 118/308; 239/427.3; 239/142; 406/46; 406/93; 406/194

[58] Field of Search ..... 118/308; 427/421, 180, 427/195; 239/427.3, 427.5, 433, 142; 406/93, 94, 95, 46, 194

[56] References Cited

U.S. PATENT DOCUMENTS

| | | | |
|---|---|---|---|
| 1,964,167 | 6/1934 | Needham | 406/194 X |
| 2,929,436 | 3/1960 | Hampshire | 427/198 |
| 3,239,146 | 3/1966 | Freda | 239/142 |
| 3,746,254 | 7/1973 | Duncan et al. | 239/15 |
| 4,212,266 | 7/1980 | Payne et al. | 118/712 |
| 4,245,551 | 1/1981 | Berkmann | 98/115 SB |
| 4,277,260 | 7/1981 | Browning | 55/273 |
| 4,314,669 | 2/1982 | Moos | 427/195 |
| 4,411,388 | 10/1983 | Muck | 239/419.5 |

OTHER PUBLICATIONS

Brochure entitled "A Short Course On Transvector Air Flow Amplifiers With Application Notes" by Vortec Corporation.

Brochure entitled "Blow Off" by Vortec Corporation.

*Primary Examiner*—Shrive P. Beck

*Attorney, Agent, or Firm*—Wood, Herron & Evans

[57] ABSTRACT

A powder spray gun and method of spraying powder wherein an inverted air flow amplifier is located adjacent to the inlet of the gun to enhance blending of powder within the gun and to facilitate sharp cut off and start up of powder flow from the gun. From the inverted air flow amplifier, the blended powder is supplied to a downstream air flow amplifier operable to draw ambient air into the downstream air flow amplifier and to impact the air entrained powder passing through the downstream amplifier with a high velocity stream of compressed air so as to accelerate the velocity of powder emitted from the gun. Powder is supplied to the upstream inverted air flow amplifier through a pair of intersecting inlet ports between which there is a separating baffle.

29 Claims, 2 Drawing Figures

POWDER SPRAY APPARATUS AND POWDER SPRAY METHOD

This application is a continuation-in-part application of U.S. application Ser. No. 623,005, filed June 21, 1984, now U.S. Pat. No. 4,543,274, and entitled "Improved Powder Spray Gun and Powder Spray Method."

This invention relates to the spraying of solid particulate powder material, and more particularly, to an improved method and apparatus for spraying solid particulate powder material.

In the above-identified application, upon which this application is an improvement, there is disclosed a novel powder spray gun for spraying a variable powder pattern, and particularly for spraying a wide conical pattern of powder. One novel aspect of the gun disclosed in the above identified patent application resides in the provision of an air flow amplifier in the gun between the gun inlet and the gun outlet. This amplifier is operable to supplement the air flow through the gun and to accelerate the powder in the course of flow through the gun. This acceleration occurs as a result of the powder being impacted by a very high velocity air stream as it passes through the amplifier. This very high velocity air stream is directed generally downstream and parallel to the flow path of the powder through the gun. As a result of the impaction of the powder by the high velocity air stream, the velocity of the powder flowing through the gun is increased. When the high velocity powder emerges from the outlet of the gun, it impacts with a generally conical deflector located in the front of the gun outlet and is caused by the deflector to be distributed in a wide conical pattern. By varying the pressure of the air supplied to the amplifier, the velocity of the air stream impacted with the powder in the amplifier may be varied and thereby the velocity of the powder emerging from the gun may be varied so as to vary the pattern of powder sprayed by the gun.

I have found that the powder spray gun described in the above-identified application is subject to periodic and apparently random changes in the spray pattern emitted from the gun. These changes are characterized by differing densities of powder within different parts of the spray pattern and by the high density part of the pattern moving from one side of the pattern to the other. This problem is particularly acute in those installations wherein two powder pumps are used to supply powder to a single gun and wherein the flow of air entrained powder from the two pumps is merged at the inlet to the gun.

It has therefore been one objective of this invention to provide an improved powder spray gun and spray method wherein the spray of powder from the gun is maintained evenly distributed throughout the pattern.

I have observed that the powder flowing from the powder gun inlet to the air flow amplifier of the gun described in the above identified application tends to waver or shift from one side to the other of the entrance to the air flow amplifier. That wavering appears to manifest itself in an uneven distribution of powder in the pattern emitted from the nozzle of the gun.

It has therefore been another objective of this invention to provide an improved powder spray gun having an air flow amplifier in the flow path of the powder through the gun wherein the powder does not waver or shift from one side to the other in the course of flow into the inlet of the air flow amplifier.

A limitation of all powder spray systems including the system disclosed in the above identified application is that they are subject to slow start-up and slow stopping of the spray cycle. The slow start-up and slow stopping of the spray cycle is primarily attributable to the inability of the system and particularly the gun to be quickly purged of powder to stop the spray cycle and to be quickly filled with powder upon start up of the spray cycle. Instead, powder tends to continue to dribble from the nozzle at the end of a spray cycle and to start slowly before building to full flow at the start of a cycle. This characteristic has, in many instances, limited powder spray application. For example, it has heretofore precluded the use of powder spraying in many "stitching" applications wherein the flow of powder is intermittent and must be sharply started up and cut off in order to create the stitched appearance.

It has therefore been another objective of this invention to provide a powder spray apparatus and a powder spray method which is characterized by sharp start up and sharp cut off of powder flow.

Still another objective of this invention has been to provide a powder spray apparatus and a powder spray method which is useful for powder "stitching" applications wherein the powder must be sprayed in an intermittent pattern of bursts of powder, the flow of which must be sharply started and stopped.

The powder spray apparatus and method of this invention which accomplishes these objectives comprises an inverted air flow amplifier operable to impact an air entrained powder flow stream supplied to the gun of the apparatus with a high velocity stream of air directed upstream or toward the powder inlet to the gun. This upstream directed high velocity air flow is operable to create turbulence internally of the inverted air flow amplifier and thereby blend or mix the powder within the inverted air flow amplifier. This inverted air flow amplifier also functions to sharply limit or stop downstream flow of powder from the inverted amplifier whenever the air flow to the powder pump supplying powder to the inverted amplifier is terminated while air flow to the inverted amplifier is maintained.

According to the practice of this invention, air entrained powder from the inverted air flow amplifier flows downstream to the inlet of a second air flow amplifier wherein the flow is impacted by a very high velocity air stream directed downstream and generally parallel to the powder flow path through the gun. This second amplifier is operative to draw powder from the upstream inverted amplifier and ambient air into the inlet of the second air flow amplifier and to increase the velocity of that powder. The air entrained powder from the second or downstream amplifier is then directed through a restrictor and out of the nozzle of the gun. This nozzle may be a slot type nozzle, particularly useful for stitching applications, or it may be a cylindrical orifice nozzle such as disclosed in the above identified patent application.

The preferred embodiment of the powder spray gun of this invention which achieves these objectives has a pair of inlets through which air entrained powder is supplied from a pair of powder pumps to the gun. At the point at which these two inlets come together or merge, there is a baffle separating the two. This baffle functions to prevent direct impact of the flows from the two inlets until the flows have been redirected into generally parallel flow paths. This feature of the invention of this application has been found to overcome the problem of the powder flow stream wavering in the course of passage through the gun and the resulting uneven distribution of powder within the pattern emitted from the gun.

These and other objects and advantages of this invention will become more readily apparent from the following description of the drawing in which.

Figure 1:
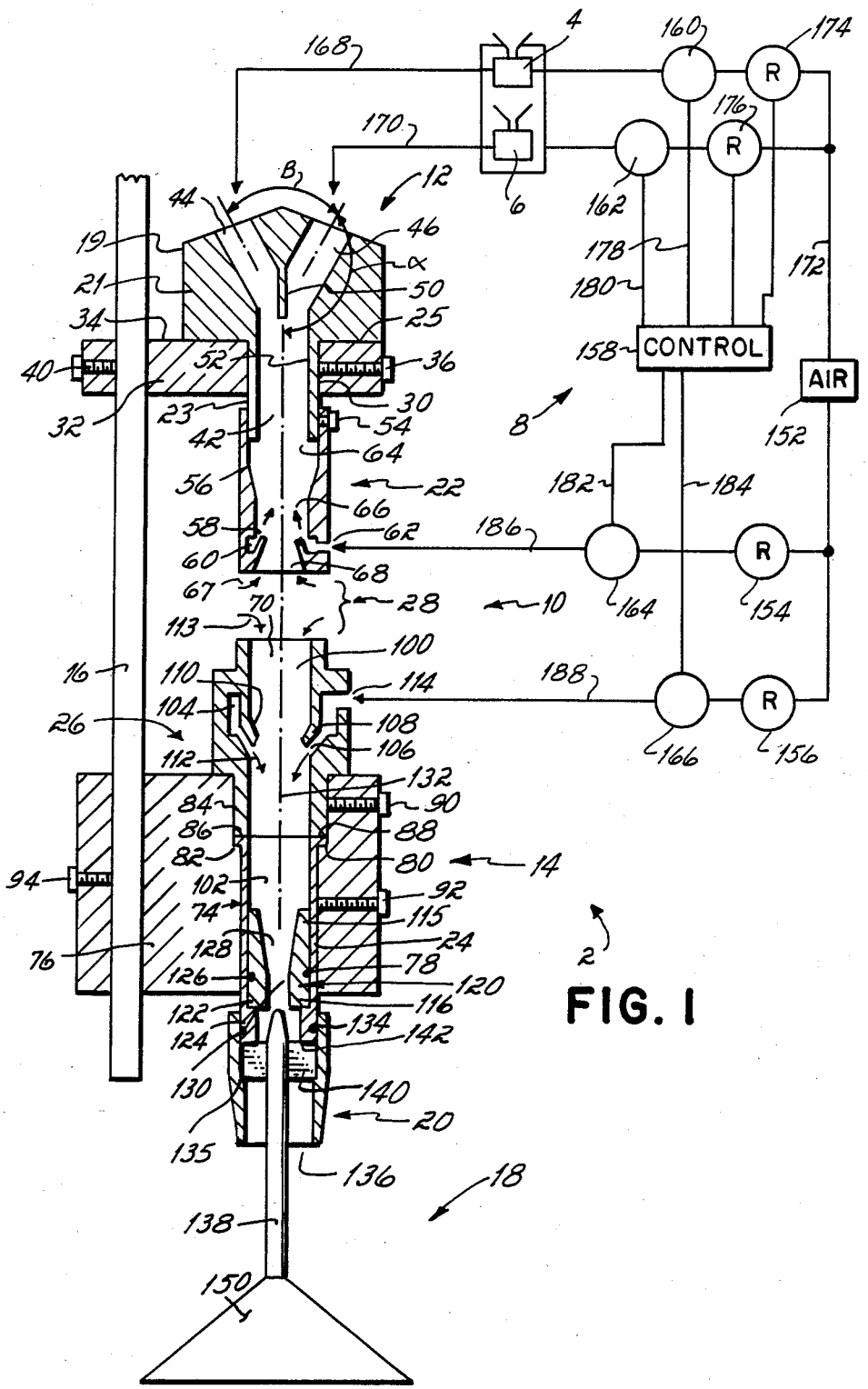
FIG. 1 is a partially diagrammatic illustration of a powder spray system including a cross-sectional view through a first embodiment of powder spray gun incorporating the invention of this application.

With reference first to FIG. 1, there is illustrated a powder spray system 2 for supplying powder from a pair of powder supply pumps 4 an 6 to a powder supply gun 10. Powder flow from the pumps to the gun 10 is controlled by a powder flow control system 8.

The powder spray gun 10 comprises a powder introduction head 12 and a powder spray barrel 14 located downstream from that head 12. Both the powder introduction head 12 and the barrel 14 are supported from a common post 16. Additionally there is a deflector 18 extending from the forward or downstream end of the gun in the path of powder emitted from the nozzle 20 of the gun. This deflector functions to deflect that powder and cause it to form a wide conically shaped spray pattern.

The powder introduction head 12 comprises a body 21 on the lower end of which there is mounted an inverted air flow amplifier 22. The barrel 14 comprises a generally tubular sleeve 24 and an air flow amplifier 26 mounted atop that sleeve 24. The outlet of the air flow amplifier 22 and the inlet of the air flow amplifier 26 are spaced apart by an air gap 28 so that, as explained more fully hereinafter, ambient or room air is free to enter both amplifiers 22, 26 and supplement the air within which powder is entrained in the course of passage through the gun 10.

The body 21 of the powder introduction head 12 comprises a large width upper end and a smaller diameter or width lower end 23, there being a shoulder. 25 between the two different diameter or width sections. The lower end 23 of the body 21 extends through an aperture 30 of a mounting bracket 32 with the shoulder 25 of the body resting atop the upper surface 34 of the bracket. The body is secured within the bracket 32 by a set screw 36 and the bracket is in turn secured to the mounting post 16 by a second set screw 40.

The lower end 23 of the body 21 has an axial bore 42 which is intersected by a pair of inlet bores 44, 46. Each of the inlet bores 44, 46 intersects the axial bore 42 at an angle $\alpha$ of approximately 150°, so that there is an included angle $\beta$ of approximately 60° between the two inlet bores 44 and 46.

According to the practice of this invention, there is a baffle 50 extending downwardly from the intersection of the two inlet bores 44, 46. This baffle extends into the upper end of the inlet bore 42. As explained more fully hereinafter, this baffle functions to separate the flow of air entrained powder through the two bores 44, 46, and to prevent the flows from these inlet bores 44, 46 from impacting with one another. As a consequence, powder flow through both of the bores 44, 46 is maintained separated until that flow straightens out and is directed in a generally axial direction in the axial bore 42. The baffle thus functions to prevent air entrained powder flow from one or the other of the inlet bores 44, 46 from overcoming the powder flow from the other bore and fastening the flow on one side or the other of the wall 52 of the axial bore 42. Instead, with the presence of the baffle 50, the merged flow from the two bores 44, 46 flows in a laminar fashion through the axial bore 42 with a relatively even flow of powder across the complete cross section of that bore 42.

The inverted air flow amplifier 22 is attached to the lower end of the body 21, beneath the mounting bracket 32. This inverted air flow amplifier 12 has an axial bore 56 extending therethrough, the upper end of which is received over the lower end 23 of the body 21. The amplifier 22 is secured onto the end 23 by a set screw 54.

That bore 56 is intersected near its lower end by an annular orifice 58. The orifice is in turn open to an annular channel 60, to which compressed air is supplied through an inlet 62. Compressed air is supplied to the inlet 62 from a pressure regulator 154 such that the pressure of the compressed air when it arrives at the inlet 62 is on the order of 5 to 30 p.s.i. The orifice 58 is directed upstream or toward the inlet end 64 of the air flow amplifier, as indicated by the arrows 66, so that compressed air entering the inlet 62 is directed upwardly or in an upstream direction relative to the downstream flow of powder through the gun. This compressed or high pressure, high velocity air flow, as indicated by the arrows 66, functions to draw ambient or room air, as indicated by arrows 67, into the inlet 68 of the amplifier 22 and to create a homogeneous air and powder mixture internally of the amplifier. This inverted amplifier 22 thus blends or better mixes powder flowing through the amplifier before that powder exits from the inverted air flow amplifier 22 via the outlet 68.

From the outlet 68 of the inverted air flow amplifier 22, the air entrained powder enters the inlet 70 of the air flow amplifier 26 which is spaced downstream from the outlet 68 of the inverted air flow amplifier 22. As a consequence of that spacing, the inlet 70 is open to flow of ambient air from the area or room surrounding the gun 10, and as explained more fully hereinafter, ambient air is drawn into that inlet 70 along with the powder entrained air from the outlet 68 of the amplifier 22.

The sleeve 24 of the barrel 14 of the gun, as well as the air flow amplifier 26, are both mounted within a stepped bore 74 of a mounting block 76. The sleeve 24 is mounted within the lower smaller diameter end section 78 of the bore 74, with a flange 80 of the barrel extending outwardly over a shoulder 82 defined between the two different diameter sections 78, 84 of the bore 74. The lower end 86 of the amplifier 26 extends into the larger diameter upper end section 84 of the bore with the lower end surface 88 of the amplifier resting atop the upper edge of the flange 80 of the sleeve 24. Both the sleeve 24 and the amplifier 26 are secured within the block 76 by set screws 90, 92, respectively. The block in turn is secured to the post 16 by a set screw 94.

The air flow amplifier 26 has a central axial bore 100 coaxially aligned with the bore 102 of the barrel 24 and coaxially aligned with the bore 56 of the inverted air flow amplifier 22. Within the amplifier 26 there is an annular air flow chamber 104, connected by an annular orifice 106 to the bore 100. An annular lip 108 extends inwardly at the rear of the orifice 106 and has a forwardly sloping surface 110 operable to deflect air flow from the orifice in a forward direction as indicated by the arrows 112. Compressed air is supplied to the annular chamber 104 via an inlet bore 114 in the amplifier. This compressed air is supplied to the inlet bore 114 from a source of pressurized air through a pressure regulator 156. In general the compressed air is supplied to the amplifier 26 at a pressure on the order of 10–60 psi.

In the use of the gun 10, air entrained powder from the inverted air flow amplifier 22 and ambient air, indicated by the arrows 113, are simultaneously drawn into the inlet 70 of the air flow amplifier 26. The vacuum for drawing the powder and air into the amplifier 26 is created by compressed air supplied to the amplifier through the bore 114 to the annular chamber 104 surrounding the bore or throat 100 of the amplifier. This compressed air passes through the annular orifice 106 and is deflected toward the outlet or discharge end of the gun by the lip 108 on the rearward side of the orifice 106. This high speed air is operable to impact the powder entrained air contained in the bore or throat 100 of the gun, and force that powder entrained air at a greater velocity forwardly through the barrel 14 of the gun while simultaneously creating a slight vacuum upstream at the entrance 70 to the amplifier 26.

Contained internally of the barrel 14 of the gun there is a restrictor or flow straightener 120. This restrictor has a lower end surface 122 which rests atop an inwardly turned flange 124 at the lower end of the barrel 18. The restrictor is frictionally secured against movement within the barrel by an O-ring 126 contained within an annular groove of the restrictor.

Internally of the restrictor there is an axial bore 128 which tapers inwardly at the upper end 115 and then is cylindrical at the lower end 116, so as to define a restricted orifice 130 in the cylindrical downstream section of the bore 128. This restrictor functions to channel the flow of powder through the gun toward the central axis 132 of the barrel and to shape the pattern sprayed from the gun. While in the preferred embodiment of this invention, the bore 128 is circular in cross section, it may be changed to a different configuration such as to an oval cross sectional configuration, to change the pattern sprayed from the gun.

The nozzle 20 is mounted on the lower end of the barrel 14. It is frictionally secured thereon by an O-ring 134 located within a groove of the sleeve 24 of the barrel.

The deflector 18 functions to disperse the flow of powder emitted from the outlet 136 of the nozzle. This deflector 18 is generally conical in shape and is suspended from an axial shaft 138. The upper end of the shaft in turn is secured to a cross-bar 140, which is in turn secured within the nozzle 20 between the bottom surface 142 of a cross bar receiving slot in the sleeve 24 and an internal shoulder 135 of the nozzle 20. The frictional securement of the nozzle 20 onto the sleeve 24 by the O-ring 134 thus secures the nozzle onto the sleeve as well as the deflector suspended from the nozzle.

The cross-bar 140 is generally rectangular in configuration, so that there is a large flow area through channels (not shown) located on opposite sides of the bar 140. Powder, after passing around the bar 140, exits from the outlet 136 of the nozzle. This powder then impacts with the diverging surface 150 of the cone-shaped deflector 18. Thus the deflector causes the relatively high velocity powder to be dispersed over a wide area. In practice, by simply varying the pressure of air from the regulator 156 to amplifier 26, the diameter of the pattern of powder dispersed from the gun may be varied or adjusted.

Air and air entrained powder flow to the gun 10 is controlled by the powder flow control system 8. This system includes an electrical controller 158, such as a programmable controller, as well as a pair of on/off solenoid operates valves 160, 162 operable to control the flow of high pressure air from the source 152 to the powder pumps 4 and 6. In the preferred embodiment, this controller 158 is also operable to control the flow of high pressure air from the source 152 to the air flow amplifiers 22 and 26 respectively through a pair of on/-off solenoid operated valves 164, 166.

The powder pumps 4 and 6 are conventional venturi powder pumps of the type more completely described in Duncan et al U.S. Pat. No. 3,746,254, assigned to Nordson Corporation. The outlets of these pumps 4 and 6 are connected to the inlets 44, 46 respectively of the powder introduction head 12 by air flow lines 168 and 170 respectively. The inlet to powder pump 4 is connected to the source of high air pressure 152 via an air line 172, a conventional pressure regulator 174, and the on/off valve 160. The inlet of powder pump 6 is connected to the source of high air pressure 152 via air flow line 172, a pressure regulator 176, and the on/off valve 162. A conventional electrical control circuit interconnects the solenoid operated valves 160, 162 to the controller 158 via electrical leads 178 and 180 respectively such that these valves are operated under the control of the electrical controller 158. Similarly, conventional electrical control circuits interconnect the solenoid operated valves 164, 166 to the electrical control 158 via electrical leads 182, 184 respectively such that these valves 164, 166 are operated under the controller 158. These valves 164, 166 in turn control the flow of high pressure air from the source 152 to the air flow amplifiers 22 and 26 respectively.

In the use of the system disclosed in FIG. 1, powder flow through the gun 10 is initiated by the controller 158 opening the solenoid valves 160, 162. This results in high pressure air being supplied through the pressure regulators 174, 176 and through the valves 160, 162 to the powder pumps 4 and 6. These powder pumps in turn supply powder simultaneously to each of the inlet ports 44, 46 of the powder introduction head 12. Alternatively powder may be supplied through one or the other of these inlets, although in most applications, powder will be supplied simultaneously to each of these inlets via the pair of powder pumps 4 and 6. This incoming powder impacts with the baffle 50 and is caused by that baffle to be directed downwardly into the bore 42 of the head 12. The presence of the baffle has been found to prevent the flow of powder from one or the other of the two inlets 44, 46 from overcoming the flow from the other inlet and fastening the powder flow to one side or the other of the bore. The air entrained powder within the bore 42 then flows downwardly into the inverted air flow amplifier 22, wherein that air-powder mixture is homogenized by the compressed air stream directed from the annular channel 60 through the orifice 58 upwardly or upstream of the powder flow through the gun. This compressed air and the ambient room air drawn into the inverted amplifier 22 by the compressed air flow through the orifice 56, creates turbulence within the bore 58 of the inverted air flow amplifier 22. This inverted air flow amplifier thus better blends or mixes the powder within that bore 56. The homogenized powder-air mixture then flows downwardly through the outlet of the inverted air flow amplifier 22 into the inlet 70 of the air flow amplifier 26. This air entrained powder is there impacted by a very high velocity air stream emitted from the annular chamber 104 of the amplifier through the orifice 106, which very high velocity air stream is directed downwardly or downstream of the gun. This high velocity air stream causes a vacuum to be drawn at the inlet 70 of the gun so as to pull ambient air into the amplifier from the surrounding air, as indicated by the arrows 113, as well as to pull air entrained powder from the inverted air flow amplifier 22. This downwardly directed air stream also increases the velocity of powder flowing through the amplifier 26 so as to cause the velocity of that powder to be materially increased from the inlet to the outlet end of the amplifier. The high velocity powder is then caused to flow through the restrictor 120 and out of the gun via the nozzle 20. The powder emerges from the nozzle at a relatively high velocity, impacts with the diverging surface 150 of the deflector 18, and is deflected outwardly into a relatively wide conical shaped pattern of powder.

To terminate powder flow from the gun, solenoid valves 160, 162 are closed via an appropriate electrical control signal from the controller 158 and thereby powder flow from the powder pumps 4 and 6 is terminated. Air flow in lines 186,188 to the air flow amplifiers 22, 26 is maintained by the valves 164, 166 remaining open. By maintaining air flow to the inverted air flow amplifier 22 after the valves 160, 162 have been closed, any powder contained in the lines between the discharge end of the amplifier 22 and the pumps 4 and 6 is held back or retained in the lines. As a result, powder flow does not continue to trickle from the nozzle 20 or discharge end of the gun 10 after air flow to the powder pumps 4 and 6 is terminated. Instead, powder flow is sharply cut off. When it is desired to again initiate flow, the valves 160, 162 are again opened and flow from the discharge end of the gun is sharply initiated. Consequently, this powder spray system 2 may be used to intermittently spray short bursts of powder or to spray bursts having sharp start-up and sharp cut-off characteristics. In the absence of the inverted air flow amplifier 22, and the ability to maintain air flow to the air flow amplifier via valve 164 when the powder flow from the pumps 4 and 6 is terminated, this sharp start-up and sharp cut-off powder flow characteristic of the gun 10 does not occur. Thus, the provision of the inverted air flow amplifier 22 in the powder gun 10 serves the dual function of homogenizing air flow from the gun and of facilitating sharp start-up and cut-off of flow from the gun.

One advantage of the system disclosed in FIG. 1 is that it effects a very even distribution of powder within a generally conically shaped pattern of powder emitted from the gun.

Still another advantage of the system disclosed in FIG. 1 is that it enables powder flow from a powder spray gun to be sharply initiated and sharply cut off so that there is no trickle or slow dissipation of powder spray patterns sprayed from the gun.

Figure 2:
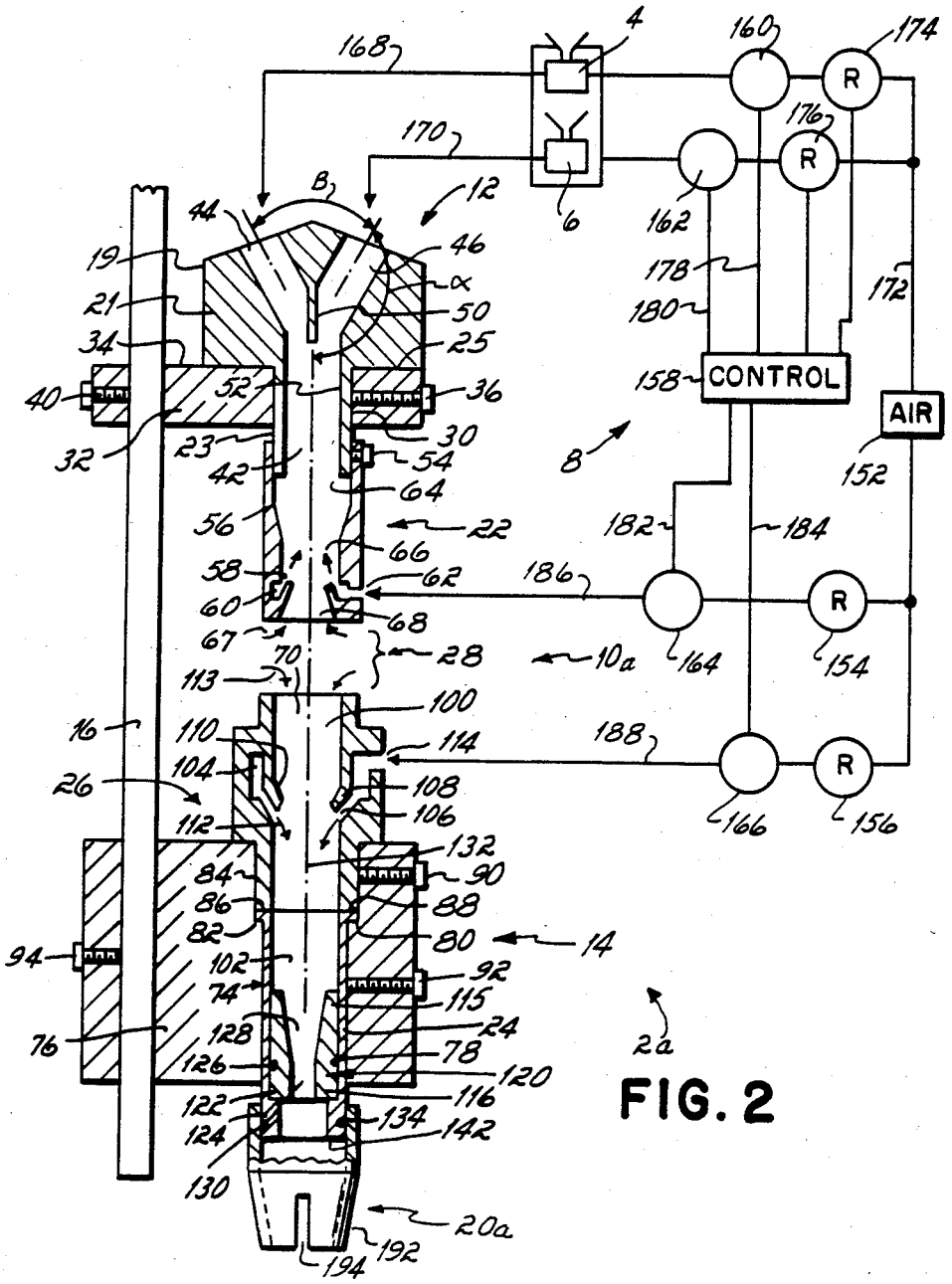
FIG. 2 is a partially diagrammatic illustration of a powder spray system including a cross sectional view through a second embodiment of a powder spray gun incorporating the invention of this application.

With reference now to FIG. 2, there is illustrated a second embodiment of the invention of this application. This embodiment is identical to the embodiment of FIG. 1 except that it utilizes a different nozzle configuration to facilitate the powder spray gun spraying a stitching pattern. A stitching pattern is one which is created by periodic or intermittent bursts of powder which are sharply started and stopped.

Those components of the system of FIG. 2 which are identical to the corresponding components of FIG. 1 have been given identical numerical designations. Those components which differ in structure but correspond generally in function have been given the same numerical designation but followed by the suffix "a".

With reference to FIG. 2, it will be seen that the nozzle **20*a* comprises a cylindrical upper end section and a tapered lower end. The cylindrical upper end section is frictionally secured onto the lower end of the barrel 14 by an O-ring 134 contained within an annular recess on the lower end of the sleeve 14** of the barrel.

The lower tapered end 192 of the nozzle **20*a* is slotted as indicated at 194** so as to generate a fan-shaped pattern of powder sprayed from the nozzle. This configuration of pattern is one which is commonly employed when spraying a stitch pattern, although other configurations of nozzles could be so used for the same purpose.

In this second embodiment of the powder spray system, powder flow through the gun and out of the nozzle **20*a* is initiated by opening of the valves 160, 162 so as to enable high pressure air to be conveyed from source 152 to the inlets of the powder spray pumps 4 and 6. This high pressure air is operable to convey air entrained powder from the pumps 4 an 6 to the inlets 44, 46 of the introduction head 12 of the powder spray gun 10*a*. Simultaneously, air is caused, under the control of the controller 158, to flow from the source of high pressure air 152 through the valves 164, 166 to the inlets 62, 114 of the amplifiers 22, 26, via lines 186, 188. Compressed air from the inlet 62 of the inverted amplifier 22 is directed upwardly or upstream of the inverted amplifier so as to create turbulence and better homogenize powder within the air flow amplifier 22. This homogenized powder-air mixture flows downwardly from the inverted amplifier 22 through the inlet of the amplifier 26 where it is impacted by the high pressure air stream emitted from the annular orifice 106 of the amplifier 26. Thereby, the powder flow is accelerated before passage out of the nozzle 20*a* of the gun 10*a*. The high pressure air flow through the orifice 106 also creates a vacuum at the inlet to the air flow amplifier 26 so as to draw air entrained powder from the inverted amplifier 22 into the inlet of the amplifier 26 and to simultaneously draw ambient air into the inlet of the amplifier 26**.

To terminate and sharply cut off the flow of powder from the gun so as to facilitate the spraying of a stitched pattern, the valves 160, 162 are closed under the control of the controller 158 while the valves 164, 166 are maintained on or in the open position. As a consequence of the valve 164 being open, and air flow being maintained to the inlet 62 of the inverted air flow amplifier 22 while flow from the pumps 4 and 6 is terminated, the flow of powder from the gun **10*a* is sharply cut off when the valves 160, 162 are closed. This sharp cut off results from the upwardly or upstream directed air flow through the outlet 58 of the inverted air flow amplifier holding back any powder which would otherwise trickle through the lines 168, 170 and from the nozzle 20*a* of the gun. To again initiate flow from the gun 10*a*, the valves 160, 162 are again opened while the valves 164, 166 remain open. This results in a sharp start-up pattern of powder flow from the gun 10*a*. If the controller 158 is programmed to rapidly and intermittently activate the valves 160, 162, the resulting powder flow from the gun 10*a* will be a sharp stitching pattern of powder flow from the gun 10*a***.

While I have described only two preferred embodiments of my invention, persons skilled in this art will appreciate changes and modifications which may be made without departing from the spirit of my invention. Therefore I do not intend that it be limited except by the scope of the following appended claims.

I claim:

1. A method of spraying solid particulate powder from a powder spray gun, which gun includes a barrel and a nozzle at the discharge end of said barrel, which barrel has a central axis, which method comprises transporting said solid particulate powder to said gun while entrained in an air stream, passing said air entrained powder through an inverted air flow amplifier wherein said air entrained powder is impacted by a relatively high velocity air stream directed generally upstream of said barrel so as to homogenize the distribution of said air entrained powder and thereby more evenly distribute said power throughout said air stream.

2. A method of spraying solid particulate powder from a powder spray gun, which gun includes a barrel and a nozzle at the discharge end of said barrel, which barrel has a central axis, which method comprises transporting said solid particulate powder to said gun while entrained in an air stream, passing said air entrained powder through an inverted air flow amplifier wherein said air entrained powder is impacted by a relatively high velocity air stream directed generally upstream of said barrel so as to homogenize the distribution of said air entrained powder and thereby more evenly distribute said powder throughout said air stream, subsequently passing said air entrained powder through an air flow amplifier wherein said air entrained powder is impacted by a high velocity air stream directed generally downstream and parallel to the axis of said barrel and operable to increase the velocity of said solid particulate material.

3. The method of claim 2 which further comprises passing said air entrained powder over a diverging surface so as to increase the width of the pattern sprayed from said gun nozzle.

4. A method of spraying solid particulate powder from a powder spray gun, which gun has a nozzle at the discharge end and a central axis, which method comprises transporting said solid particulate powder to said gun while entrained in an air stream, impacting said air entrained power with a relatively high velocity air stream of compressed air directed generally upstream of said gun so as to create homogenity of said powder in said air stream and thereby more evenly distribute said powder throughout said air stream, subsequently passing said air entrained powder axially through an air flow amplifier having a central axis extending parallel to the axis of said gun, supplying compressed air to said air flow amplifier, impacting said air entrained powder with a high velocity stream of said compressed air directed generally downstream and parallel to the axis of said amplifier and operable to increase the velocity of said solid particulate powder in a downstream axial direction.

5. The method of claim 4 which further comprises passing said air entrained powder over a diverging surface so as to increase the width of the pattern sprayed from said gun nozzle.

6. The method of claim 5 which further comprises varying the pressure of said compressed air in said air flow amplifier so as to vary the width of the pattern sprayed from said gun.

7. A powder spray gun for spraying air entrained solid particulate powder material, which gun has an inlet end and a discharge end, means for transporting solid particulate powder entrained in an air stream to said inlet end of said gun, impacting means for impacting said air entrained powder with a relatively high velocity air stream of compressed air directed generally upstream of said gun so as to create homogenity of said powder in said air stream and thereby more evenly distribute said powder throughout said air stream, and air flow amplifier means connected to said gun upstream of said gun outlet and downstream of said impacting means, said air flow amplifier means being operable to impact said air entrained powder with a high velocity air stream directed generally downstream of said gun in the course of passage of said air entrained powder through said gun.

8. The powder spray gun of claim 7 wherein said impacting means comprises an inverted air flow amplifier having a downstream end open to ambient air and an upstream end in communication with said powder receiving means.

9. The powder spray gun of claim 7 which further includes a powder dispersing deflector adjacent said outlet end of said barrel, said deflector having a diverging surface over which the air entrained powder is passed in the course of being discharged from said gun so as to establish a wide dispersion pattern of said powder.

10. The powder spray gun of claim 7 wherein said air flow amplifier means comprises an amplifier nozzle having a central axial bore aligned with the flow path of powder through said gun, said amplifier nozzle having an inlet open to ambient air and in fluid communication with said impacting means, an annular air chamber surrounding said amplifier nozzle, an air inlet into said annular air chamber, means for connecting said air inlet to a source of compressed air, and an annular orifice connecting said annular air chamber to said bore of said amplifier nozzle.

11. The powder spray gun of claim 10 wherein said air flow amplifier means has an annular lip surrounding said annular orifice, said lip being operable to deflect air emitted from said orifice toward said outlet end of said gun.

12. The powder spray gun of claim 7 wherein said receiving means comprises a pair of intersecting inlet ports, and a baffle separating said inlet ports at the point of intersection thereof.

13. The powder spray gun of claim 12 wherein said inlet ports intersect at an included acute angle and wherein said baffle substantially bisects the conjugate angle of said included acute angle.

14. The powder spray gun of claim 7 which further includes transport means for transporting said air entrained powder from an outlet of said air flow amplifier to said discharge end of said gun, said transport means including an air flow restrictor having a bore through which said air entrained powder passes in the course of passage from said outlet of said air flow amplifier to said gun outlet, said restrictor bore having an upstream end and a downstream end, said restrictor bore having a restricted orifice therein, and said restrictor bore being tapered inwardly from said upstream end of said restrictor to said restricted orifice.

15. The powder spray gun of claim 14 wherein said downstream end of said restrictor bore is generally cylindrical in configuration.

16. A powder spray gun for spraying air entrained solid particulate material, which gun comprises an inlet end and a discharge end, means for connecting said inlet end to a source of air entrained powder, a nozzle on the discharge end of said gun, impacting means for impacting said air entrained powder with a relatively high velocity air stream of compressed air directed generally upstream of said gun so as to create homogenity of powder in said air stream and thereby more evenly distribute said powder throughout said air stream, and air flow amplifier means downstream of said impacting means, said air flow amplifier means being operable to draw ambient air into said air flow amplifier and to impact said air entrained powder with a high velocity stream of compressed air in the course of passage of said air entrained powder through said gun.

17. The powder spray gun of claim 16 wherein said impacting means comprises an inverted air flow amplifier having a downstream end open to ambient air and an upstream end in communication with said powder receiving means.

18. The powder spray gun of claim 16 which further includes a powder dispersing deflector adjacent the discharge end of said barrel of said gun, said deflector having a diverging surface over which the air entrained powder is passed in the course of being discharged from said gun so as to establish a wide dispersion pattern of said powder.

19. A powder spray gun for spraying air entrained solid particulate powder, which gun has an inlet end and a discharge end, means for receiving solid particulate powder entrained in an air stream at said inlet end of said gun, impacting means for impacting said air entrained powder with a relatively high velocity air stream of compressed air directed generally upstream of said gun so as to create homogenity of said powder in said air stream and thereby more evenly distribute said powder throughout said air stream, said impacting means comprising an inverted air flow amplifier having a downstream end open to ambient air and an upstream end in communication with said powder receiving means, and means for transporting said air entrained powder from said inverted air flow amplifier to said discharge end of said gun.

20. A method of sharply cutting off the flow of solid particulate powder from a powder spray gun, which method comprises, transporting solid particulate powder to said gun while entrained in an air stream, passing said air entrained powder through an inverted air flow amplifier to which high pressure air is supplied and wherein said air entrained powder is impacted by a relatively high velocity stream of said high pressure air directed generally upstream of said barrel, and terminating the flow of said powder to said gun while maintaining said high pressure air flow to said inverted air flow amplifier so as to sharply cut off the flow of powder from said gun.

21. A method of sharply cutting off the flow of powder from a powder spray gun, which method comprises transporting said solid particulate powder to said gun while entrained in an air stream, impacting said air entrained powder with a relatively high velocity air stream of compressed air directed generally upstream of said gun so as to create homogeneity of said powder in said air stream and thereby more evenly distribute said powder throughout said air stream, and terminating the flow of said powder to said gun while maintaining the flow of said high velocity air stream of compressed air directed generally upstream of said gun so as to sharply cut off the flow of powder from said gun.

22. A powder spray system including a powder spray gun for spraying air entrained solid particulate powder, which gun has an inlet end and a discharge end, supply means including a powder pump for supplying solid particulate powder entrained in an air stream to said inlet end of said gun, impacting means for impacting said air entrained powder with a relatively high velocity air stream of compressed air directed generally upstream of said gun, and control means for terminating the flow of powder from said supply means to said inlet end of said gun while maintaining the flow of said high velocity air stream of compressed gas directed generally upstream of said gun so as to sharply cut off the flow of powder from said gun.

23. The powder spray system of claim 22 which further includes an air flow amplifier means connected to said gun upstream of said gun outlet and downstream of said impacting means, said air flow amplifier means being operable to draw ambient air into said air flow amplifier means and to impact said air entrained powder with a high velocity air stream directed generally downstream of said gun in the course of passage of said air entrained powder through said gun.

24. The powder spray gun of claim 23 wherein said impacting means comprises an inverted air flow amplifier having a downstream end open to ambient air and an upstream end in communication with said powder receiving means.

25. The powder spray gun of claim 23 wherein said air flow amplifier means comprises an amplifier nozzle having a central axial bore aligned with the flow path of powder through said gun, said amplifier nozzle having an inlet open to ambient air and in fluid communication with said impacting means, an annular air chamber surrounding said amplifier nozzle, an air inlet into said annular air chamber, means for connecting said air inlet to a source of compressed air, and an annular orifice connecting said annular air chamber to said bore of said amplifier nozzle.

26. The powder spray gun of claim 25 wherein said air flow amplifier means has an annular lip surrounding said annular orifice, said lip being operable to deflect air emitted from said orifice toward said outlet end of said gun.

27. A method of sharply starting up and sharply cutting off the flow of solid particulate powder from a powder spray gun, which method comprises, transporting solid particulate powder to said gun while entrained in an airstream, passing said air entrained powder through an inverted air flow amplifier to which high pressure air is supplied and wherein said air entrained powder is impacted by a relatively high velocity stream of said high pressure air directed generally upstream of said barrel, and terminating and restarting the flow of said powder to said gun while maintaining said high pressure air flow to said inverted air flow amplifier so as to sharply cut off and sharply restart the flow of powder from said gun.

28. A method of sharply starting up and sharply cutting off the flow of powder from a powder spray gun, which method comprises, transporting said solid particulate powder to said gun while entrained in an airstream, impacting said air entrained powder with a relatively high velocity airstream of compressed air directed generally upstream of said gun, and terminating and restarting the flow of said powder to said gun while maintaining the flow of said high velocity airstream of compressed air directed generally upstream of said gun so as to sharply cut off and restart the flow of powder from said gun.

29. A powder spray system including a powder spray gun for spraying air entrained solid particulate powder, which gun has an inlet end and a discharge end, supply means including a powder pump for supplying solid particulate powder entrained in an airstream to said inlet end of said gun, impacting means for impacting said air entrained powder with a relatively high velocity airstream of compressed air directed generally upstream of said gun, and control means for repeatedly terminating and restarting the flow of powder from said supply means to said inlet end of said gun while maintaining the flow of said high velocity airstream of compressed gas directed generally upstream of said gun so as to repeatedly sharply cut off and sharply restart the flow of powder from said gun.

* * * * *